US005764132A

United States Patent [19]

Hill

[11] Patent Number: 5,764,132

[45] Date of Patent: Jun. 9, 1998

[54] COMBINED INTERIOR HANDBAG PERSON ALARM AND LIGHT DEVICE

[76] Inventor: Margaret Hill, 8109 Kipling Avenue, Apt. #5, Woodbridge, Ontario, Canada, L4L 2A2

[21] Appl. No.: 613,523

[22] Filed: Mar. 11, 1996

[51] Int. Cl.[6] ..... G08B 23/00

[52] U.S. Cl. ..... 340/321; 340/571; 340/573; 340/691; 362/156

[58] Field of Search ..... 340/321, 568, 340/571, 573, 574, 691; 362/156, 190, 191, 200, 253

[56] References Cited

U.S. PATENT DOCUMENTS

| | | | |
|---|---|---|---|
| 4,837,559 | 6/1989 | Green, Sr. | 340/574 |
| 5,001,462 | 3/1991 | Seemann et al. | 340/574 |
| 5,005,111 | 4/1991 | Teal | 362/156 |
| 5,018,057 | 5/1991 | Biggs et al. | 362/156 |
| 5,082,281 | 1/1992 | Berghofer | 340/323 R |
| 5,345,221 | 9/1994 | Pons et al. | 340/571 |
| 5,444,605 | 8/1995 | Rivera | 362/156 |

*Primary Examiner*—Edward Lefkowitz

[57] ABSTRACT

The present invention provides for a personal alarm and light device comprising a case having a top, bottom, front, back and side surfaces. A clip is provided on the back surface of the case for releasably attaching the device to a purse or a bag. The device further includes an audible alarm provided on the front surface and a light for providing illumination on the bottom surface. The device includes first and second switches for activating the alarm and light on the top and at least one side surface and a power supply within the case to provide power to the alarm and the light.

3 Claims, 1 Drawing Sheet

COMBINED INTERIOR HANDBAG PERSON ALARM AND LIGHT DEVICE

FIELD OF THE INVENTION

The present invention relates to a combined personal alarm and light device, in particular, a device for releasably securing to a purse, handbag, briefcase or other such carry bag.

BACKGROUND OF THE INVENTION

Presently, various personal alarm devices are available for use by persons, especially women, when walking at night. When the person carrying the alarm is in danger, particularly in danger of being attacked, the alarm can be activated and an audible alarm is emitted by the alarm device, the purpose of which is to scare off the potential attacker. A number of such personal alarm devices have also been developed which, in addition to the alarm, incorporate a light. Such devices are generally carried in a purse on the person and the light is utilized to illuminate the interior of a purse to make it easier to locate, for example, the keys to one's car.

One example of such a device is shown in U.S. Pat. No. 5,001,462 which describes a personal alarm and light device which can be worn by the user or alternatively releasably attached to a handbag. Another such device is illustrated in U.S. Pat. No. 5,005,111 which describes a light assembly for use in a purse releasably attached to the inside surface of the purse and which includes an alarm that generates an audible signal after a pre-set time interval unless the alarm is deactivated. In both of these examples, the alarm and light devices are attached to the purse through the use of hook and loop fastener.

SUMMARY OF THE INVENTION

The present invention provides for a personal alarm and light device comprising a case having a top, bottom, front, back and side surfaces. A clip means is provided on the back surface of the case for releasably attaching the device to a purse or a bag. The device further includes an audible alarm provided on the front surface and a light means for providing illumination on the bottom surface. The device includes switch means for activating the alarm and light on the top and at least one side surface and a power supply within the case to provide power to the alarm and the light means.

BRIEF DESCRIPTION OF THE DRAWINGS

Preferred embodiments of the present invention are illustrated in the drawings, wherein.

DETAILED DESCRIPTION OF THE PREFERRED EMBODIMENTS

Figure 1:
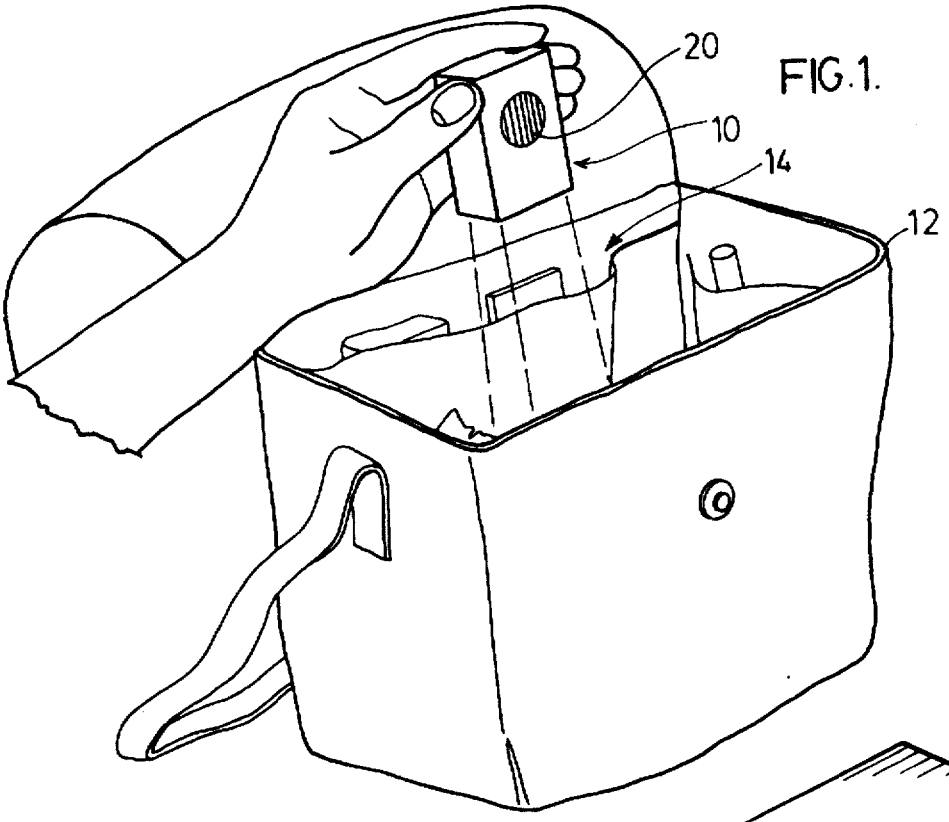
FIG. 1 is a perspective view of a device of a preferred embodiment of the present invention in use in a purse.
Figure 2:
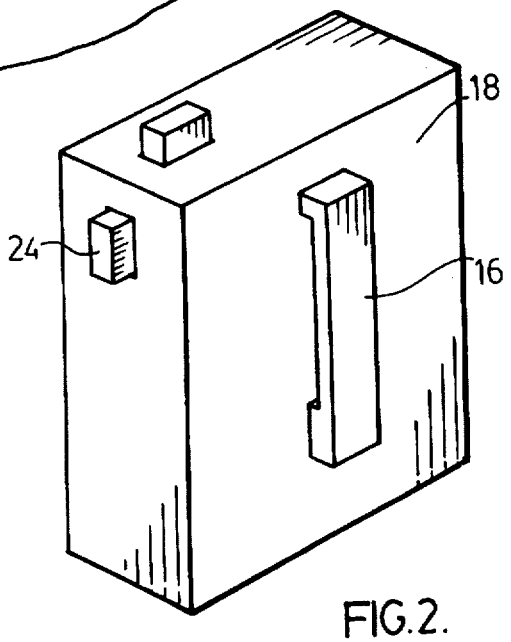
FIG. 2 is a perspective view of the rear of the device of FIG. 1.

FIG. 1 illustrates a preferred embodiment of the personal alarm and light device of the present invention generally indicated by the numeral 10. Device 10 is for use particularly within a ladies' purse 12, handbag or other type of carrying bags such as a briefcase or tote. Many such purses 12 have an interior pocket 14 to which the device 10 is attached by means of the clip 16 attached to the rear surface 18 of the device 10. The use of clip 16 as a releasably securing means for releasably attaching the device to the purse provides for increased flexibility in the use of the device 10 as it is not necessary to provide complementary hook and loop fastening where the one-half of the fastening means would have to be attached to the purse. Rather the clip 16 is easily slipped over the opening of a pocket 14 within the interior of the purse 12.

Figure 3:
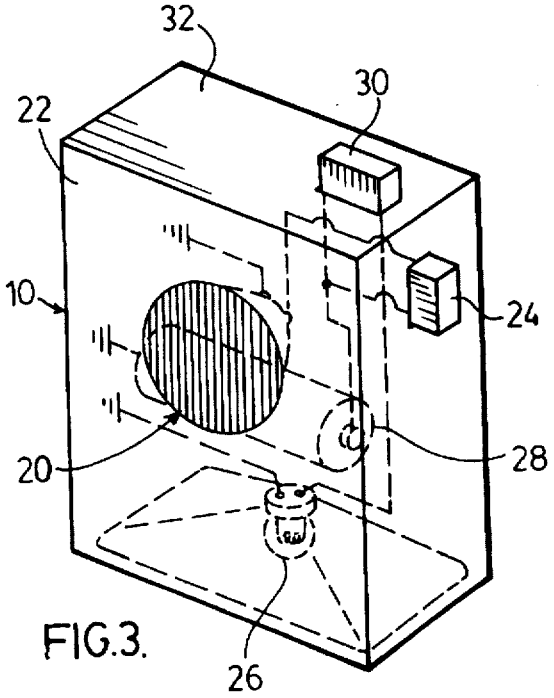
FIG. 3 is a perspective view of the front of the device of of FIG. 1 partly in section illustrating the interior components.

As illustrated in FIGS. 1 and 3, the device 10 is provided with an audible alarm 20 on the front surface 22 of the device 10. Preferably, such audible alarm 20 emits a sound of at least 80 decibels, most preferably about 120 decibels, to increase the likelihood of warding off a potential thief or attacker. The device also includes an activating switch 24 for activating the alarm 20. As illustrated in the Figures, in the preferred embodiment, activating switch 24 is located on this side of the device, however, other positions are possible as will be explained below.

Device 10 further includes light means 26 for providing illumination within the interior of the purse 12. It has been found that the best position for the light means 26 is on the bottom of the device 10 as this enables the light to best illuminate the interior of the purse 12 while minimizing the possibility of the light shining into the eyes of the user. As illustrated in the Figures, light means 26 is preferably a small voltage light bulb the size of which is dependent upon the power supply provided within the device 10. The device 10 also includes a power supply 28 within the device to provide power to the alarm 20 and the light means 26. As illustrated in the Figures in the preferred embodiment, the power supply is preferably a battery 28 and the sizing and number of such battery will be selected dependent upon the power requirements of the audible alarm 20 and the light source 26. Device 10 is further provided with an activating switch 30 for the light source located on the top surface 32 of the device. However, as described above with respect to the activating switch 24 for the alarm 20, the position of these two activating switches 24 and 30 may be reversed.

The personal alarm and light device of the present invention provides for a secure, convenient and practical such device capable of providing the user with the feeling of safety and piece of mind. The use of the 120 decibel audible alarm in the preferred embodiment aids in the security of the user as the level of sound produced by such an audible alarm is very loud and is more likely to attract attention to the user and reduce the likelihood of continued threat to the user. The provision of the clip for attachment allows the alarm unit to be attached to almost anything, like the interior of a bag, purse, briefcase, backpack, diaper bag, suitcase, etc. In addition, should it be desired, the device could also be worn on the belt or at the waist of a user. The provision of the light means in the bottom of the device provides for the light shining in a fan-type manner providing for illumination throughout the interior of the purse or briefcase, etc., without directly shining in the eyes of the user. The provision of the switches for the activation of the light and the alarm on different surfaces aids in preventing confusion once the user is familiar with the positioning of the activation switches. As the user is more likely to grasp the device within the palm and thus have the activation switch at the side closest to the finger, it is preferred that this be the location for the activation switch for the alarm. The alarm device of the present invention provides for an improved combined alarm and light device for use by persons of all ages to aid their personal security.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A combined personal alarm and light device comprising a case having a top, bottom, front, back and side surfaces, a clip means provided on the back surface for releasable attaching the device to a purse or a bag, an audible alarm provided on the front surface of the device, a light means for providing illumination provided on the bottom surface, first switch means for activating the alarm provided on a side surface and second switch means for activating the light means provided on the top surface, and power supply means within the case to provide power to the alarm and light means.

2. A combined alarm and light device as claimed in claim 1 wherein the audible alarm produces a sound level of at least 80 decibels when activated.

3. A combined alarm and light device as claimed in claim 1 wherein the audible alarm produces a sound level of at least 120 decibels when activated.

* * * * *